US006805058B2

(12) United States Patent
Eches et al.

(10) Patent No.: US 6,805,058 B2
(45) Date of Patent: Oct. 19, 2004

(54) SABOT FOR FIN-STABILIZED AMMUNITION

(75) Inventors: Nicolas Eches, Plaimpied Givaudins (FR); Jacques Bachelier, Plaimpied Givaudins (FR); Joël Leblond, Bourges (FR); Jean-Paul Fauchon, La Chapelle Saint Ursin (FR); Dominique Dion, Bourges (FR)

(73) Assignee: GIAT Industries, Versailles (FR)

( * ) Notice: Subject to any disclaimer, the term of this patent is extended or adjusted under 35 U.S.C. 154(b) by 0 days.

(21) Appl. No.: 10/357,465

(22) Filed: Feb. 4, 2003

(65) Prior Publication Data

US 2003/0145756 A1 Aug. 7, 2003

(30) Foreign Application Priority Data

Feb. 4, 2002 (FR) ..... 02 01251

(51) Int. Cl.[7] ..... F42B 14/06

(52) U.S. Cl. ..... 102/521; 102/520; 102/522; 102/523

(58) Field of Search ..... 102/520, 521, 102/522, 523

(56) References Cited

U.S. PATENT DOCUMENTS

| | | | | | |
|---|---|---|---|---|---|
| 2,669,930 | A | * | 2/1954 | Darby et al. | 102/523 |
| 2,998,780 | A | * | 9/1961 | Anspacher et al. | 102/523 |
| 3,262,391 | A | * | 7/1966 | Shobar | 102/521 |
| 3,620,167 | A | * | 11/1971 | Romer et al. | 102/521 |
| 3,714,900 | A | * | 2/1973 | Feldmann | 102/522 |
| 3,738,279 | A | * | 6/1973 | Eyre et al. | 102/521 |
| 4,140,061 | A | * | 2/1979 | Campoli | 102/529 |
| 4,142,467 | A | * | 3/1979 | Stahlmann et al. | 102/523 |
| 4,408,538 | A | * | 10/1983 | Deffayet et al. | 102/522 |
| 4,450,770 | A | * | 5/1984 | Kirkendall et al. | 102/523 |
| 4,516,502 | A | * | 5/1985 | Klein et al. | 102/523 |
| 4,608,927 | A | * | 9/1986 | Romer et al. | 102/521 |
| 4,702,172 | A | * | 10/1987 | Wallow et al. | 102/521 |
| 4,860,661 | A | * | 8/1989 | Bock et al. | 102/523 |
| 4,920,889 | A | * | 5/1990 | Luther | 102/521 |
| 5,003,886 | A | * | 4/1991 | Pahnke et al. | 102/521 |
| 5,025,731 | A | * | 6/1991 | Meyer et al. | 102/521 |
| 5,359,938 | A | | 11/1994 | Campoli et al. | 102/521 |
| H1412 | H | | 2/1995 | Kline et al. | 102/521 |
| 5,493,974 | A | * | 2/1996 | Bilgeri | 102/522 |
| 5,789,699 | A | * | 8/1998 | Stewart et al. | 102/521 |
| H1999 | H | * | 11/2001 | Newill et al. | 102/521 |

FOREIGN PATENT DOCUMENTS

| | | | |
|---|---|---|---|
| EP | 0 086 711 A1 | | 8/1983 |
| EP | 0086711 | * | 8/1983 |
| EP | 0 123 299 A2 | | 10/1984 |
| EP | 0 384 099 A2 | | 8/1990 |
| EP | 0403730 | * | 12/1990 |
| EP | 0123299 | * | 10/1994 |
| GB | 2233072 | * | 1/1991 |
| GB | 2251676 | * | 7/1992 |

* cited by examiner

*Primary Examiner*—Jack Keith
*Assistant Examiner*—John Richardson
(74) *Attorney, Agent, or Firm*—Oliff & Berridge, PLC

(57) ABSTRACT

The invention relates to a sabot for fin-stabilized ammunition composed of segments assembled around a sub-calibrated penetrator. The sabot is characterized in that it includes at least three longitudinal bars of a substantially constant width, each having indentations co-operating with an external profile of the penetrator to allow it to be driven, as well as a calibrated thrust plate integral with the bars.

Figure 1:
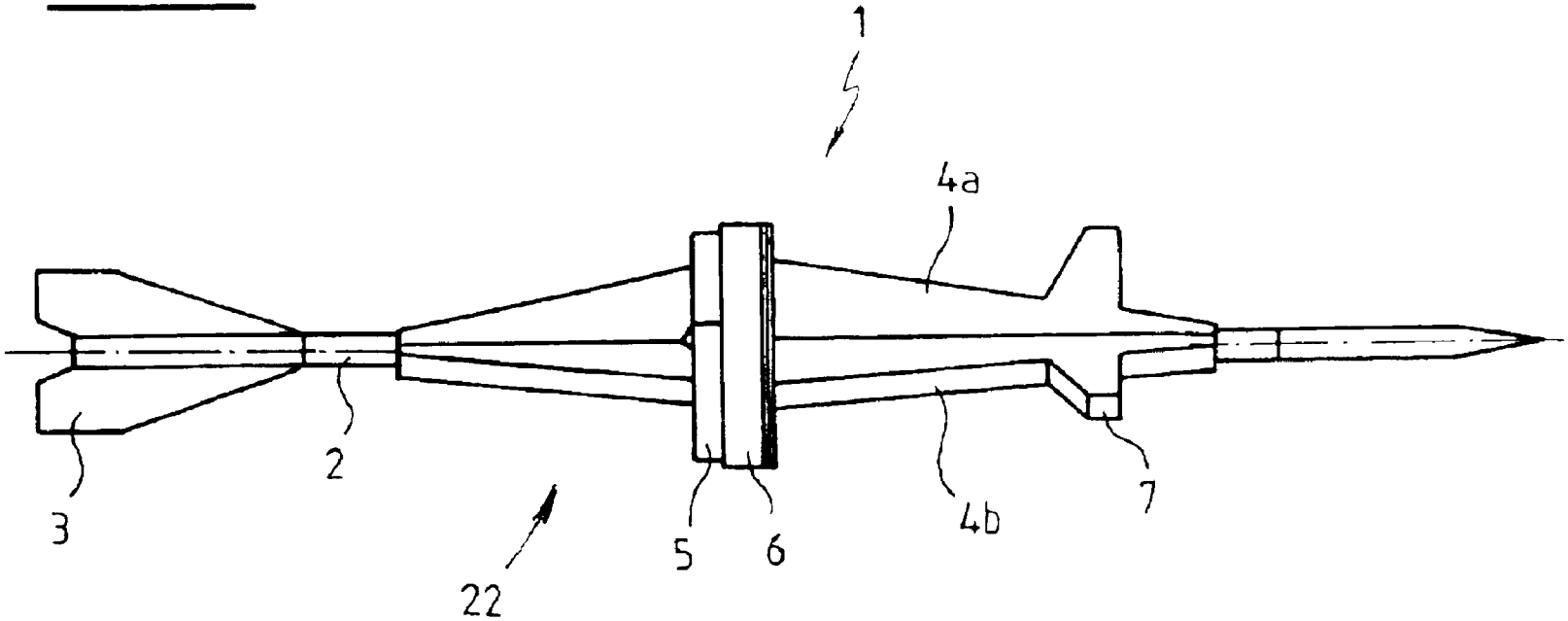

Application to projectile firings.

15 Claims, 7 Drawing Sheets

SABOT FOR FIN-STABILIZED AMMUNITION

BACKGROUND OF THE INVENTION

The technical scope of the present invention is that of sabots for fin-stabilized projectiles, in particular large caliber.

Fin-stabilized projectiles are classically constituted by a penetrator made of a heavy material such as tungsten or uranium alloy to which a sabot is added to ensure its propulsion through the gun barrel.

The sabot is generally axisymmetrical and is made of aluminum alloy, either by machining a heat treated wire bar, or by impact forging.

Mostly of the time, the sabot is constituted by three segments linked to the penetrator by threading or grooves allowing the penetrator to be driven in translation. The sabot segments are joined together by a belt that also acts as a seal between the gun barrel and the sabot. Known sabots generally incorporate three zones: the body itself to retain and drive the penetrator, the thrust plate, of the same calibre as the barrel with respect to which it guides the sabot and which withstands the pressure generated by the gases, and lastly the front pocket.

The front pocket generally presses against the barrel walls and participates in guiding the projectile.

Upon exiting the barrel, the front pocket receives the aerodynamic pressure which results in a stress perpendicular to the penetrator that is enough to break the retaining rings and belts and to separate the sabot segments so as to release the penetrator which alone continues its ballistic flight towards the target.

We understand that the sabot constitutes a dead weight that must be discarded as soon as possible and which additionally consumes available kinetic energy.

Trials have been carried out to reduce the sabot's mass.

Thus, patent GB-A-2251676 describes a sabot whose segments are constituted by laminar elements of a composite material whose fibers are oriented. The drawback of such an arrangement lies in the multitude of elements composing the sabot and making it difficult to manufacture. U.S. Pat. No. 4,958,571 is known that describes a particular sabot comprising continuous filaments and in which the rear of the penetrator is covered by means of these filaments, which are long enough to reduce the bending stress on the sabot. It is specified in this patent that the fibers must break upon exiting the barrel in order to separate the sabot.

All the attempts made to date have lead to sabots of a non-negligible masse since said sabot must ensure both the driving of the penetrator, its guidance in the barrel and its resistance to the firing constraints.

The minimal section of the sabot is calculated by considering that the projectile follows a perfectly rectilinear trajectory and that the pressure load is perfectly axisymmetrical. This results in a sabot being defined that is not always transversally rigid enough, requiring material to be added either by increasing the diameter or by adding ribs.

SUMMARY OF THE INVENTION

The aim of the present invention is to propose a sabot having a reduced mass, that is easy to manufacture and requires no reinforcing means to ensure its transversal rigidity.

The invention thus relates to a sabot for fin-stabilized ammunition composed of calibrated segments assembled around a sub-calibrated penetrator, wherein it comprises at least three longitudinal bars of a substantially constant width and each having indentations co-operating with an external profile of the penetrator to allow it to be driven, as well as a calibrated thrust plate integral with the bars.

The bars may have a prismatic cross section.

The bars will advantageously be of a thickness similar to the penetrator's diameter.

Each bar may carry a stud on its front part to provide guidance in the gun barrel.

The thrust plate may have a sealing belt that also joins the bars to the penetrator.

According to one embodiment, the thrust plate may be divided into at least three adjoining sectors, each bar carrying one sector of the thrust plate.

Each sector may in this case incorporate a radial notch that caps a matching notch carried on the bar.

Bars and sectors may be made of the same material. Each sector may be made as a single part with its bar.

According to another embodiment, the thrust plate may be divided into at least three adjoining sectors, each sector incorporating a footplate applied to the penetrator and integral with a calibrated wall, the walls of two adjoining sectors delimiting a gap to receive a bar.

Each bar may in this case comprise a recess on its face applied to the penetrator that caps the footplates of two adjoining sectors.

Each bar may incorporate two radial slots reducing its thickness at a median part, such slots receiving the walls of two sectors of the thrust plate.

In all the embodiments, the bars may be made of a composite material whereas the sectors will be made of a metallic material.

A first advantage of the sabot according to the invention lies in the substantial reduction of the sabot's mass.

Another advantage lies in the ease of manufacture of the sabot leading to lower manufacturing costs.

Another advantage lies in the fact that each sabot segment does not have to be specially machined.

BRIEF DESCRITION OF THE DRAWINGS

Figure 2:
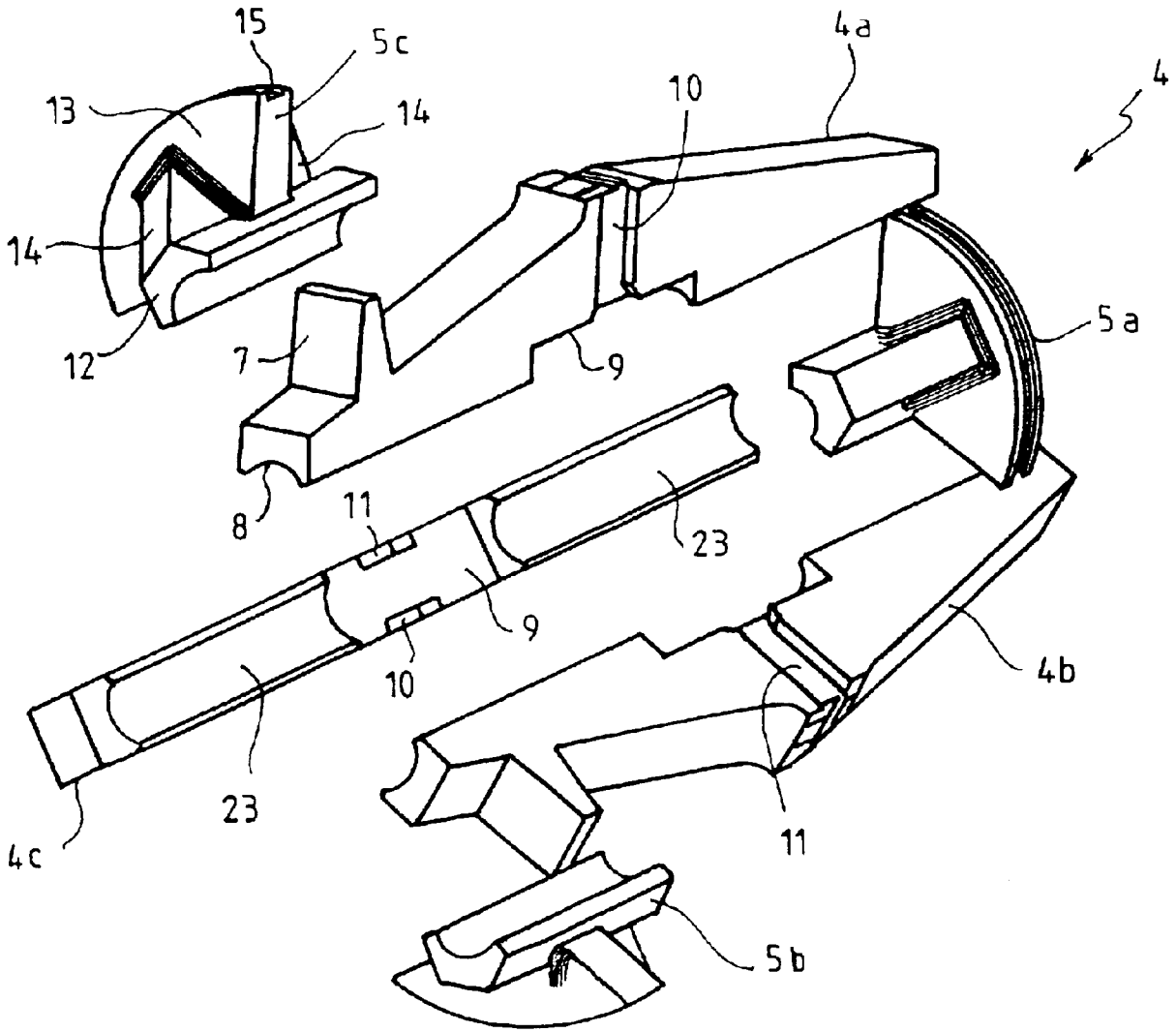
Figure 3:
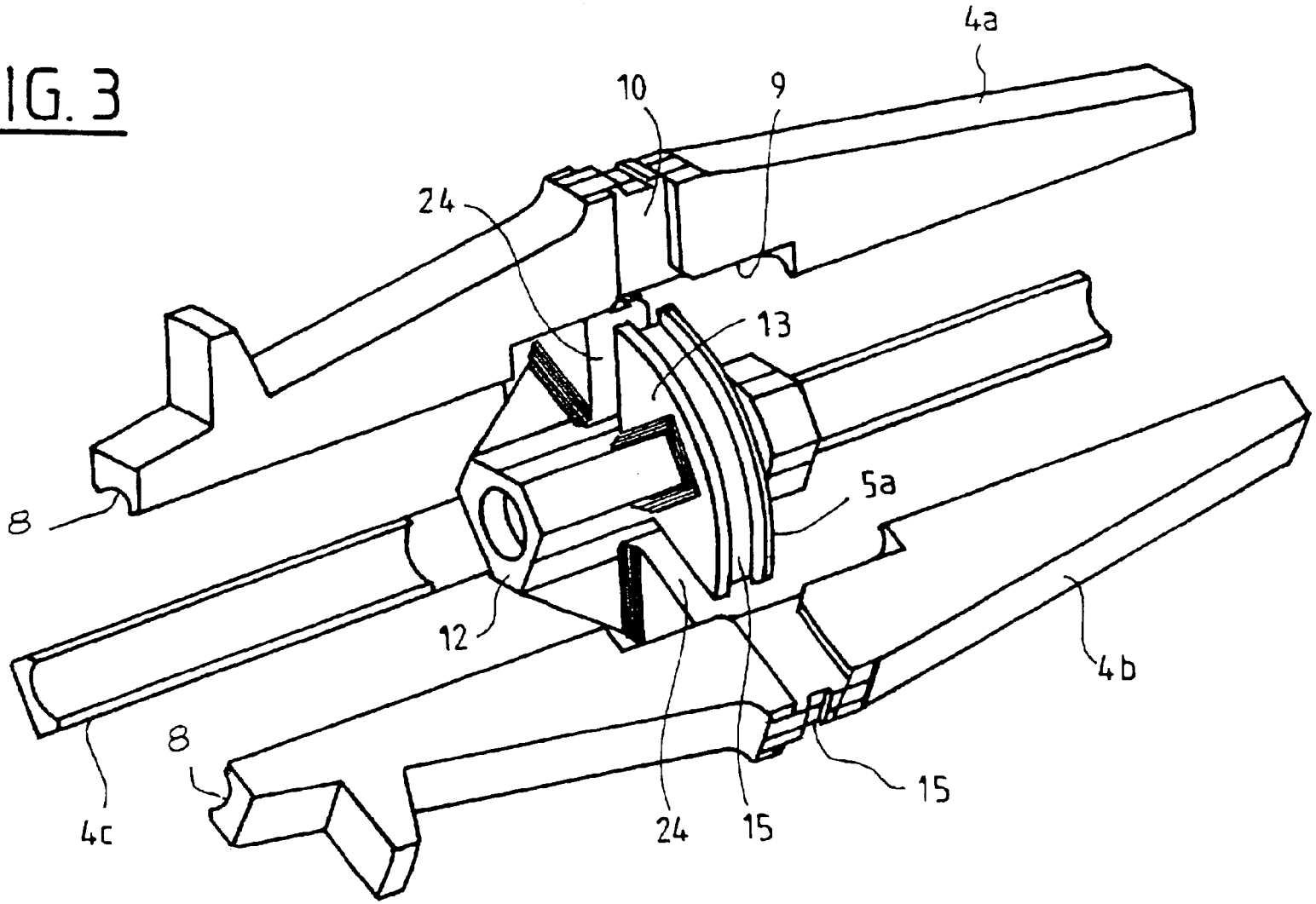
Figure 4:
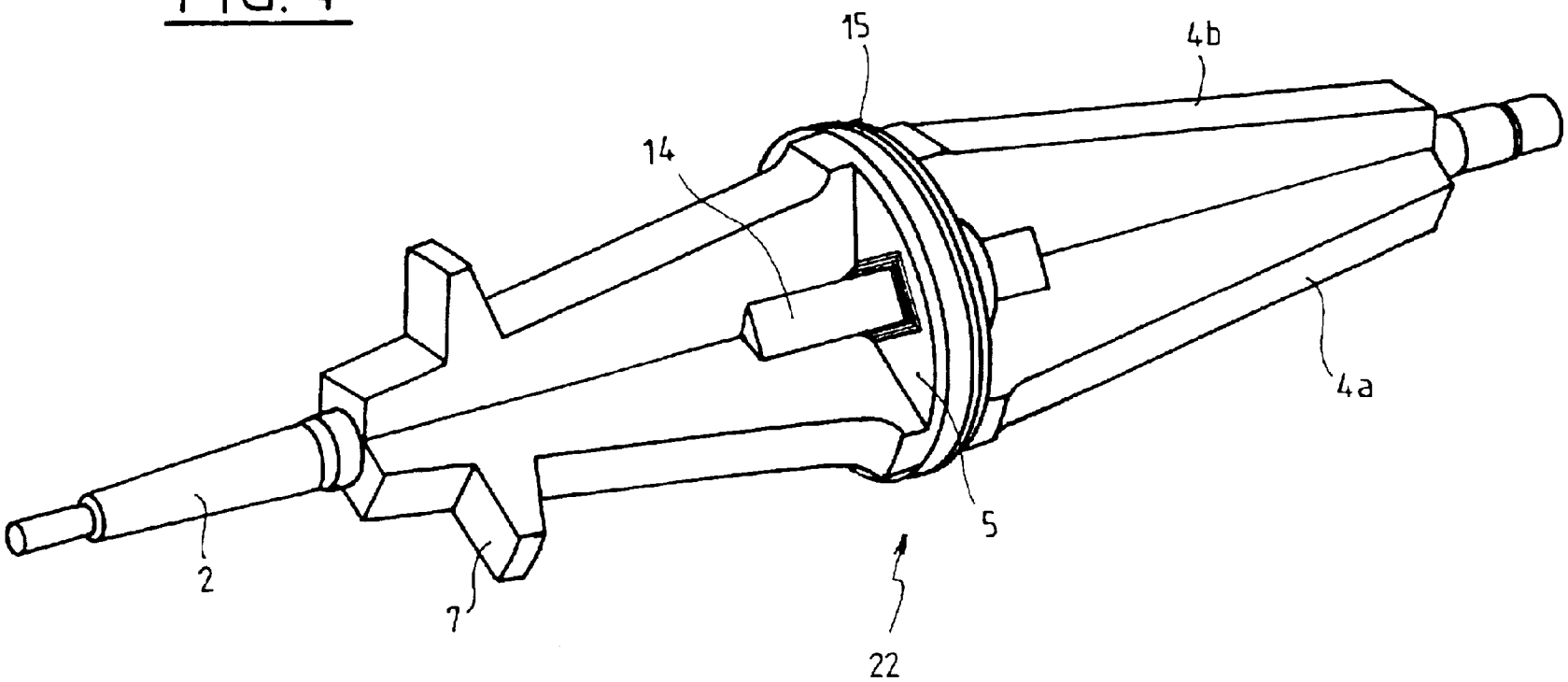
Figure 5:
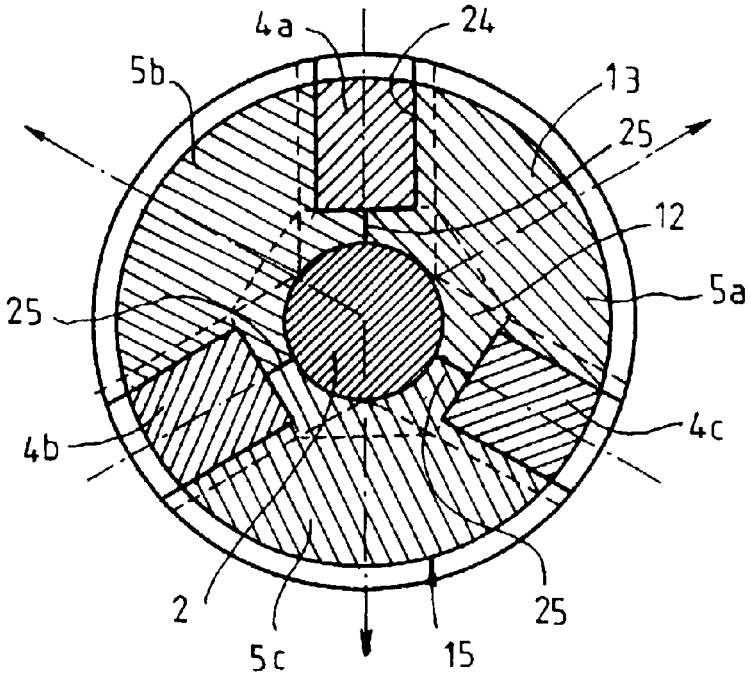
Figure 9:
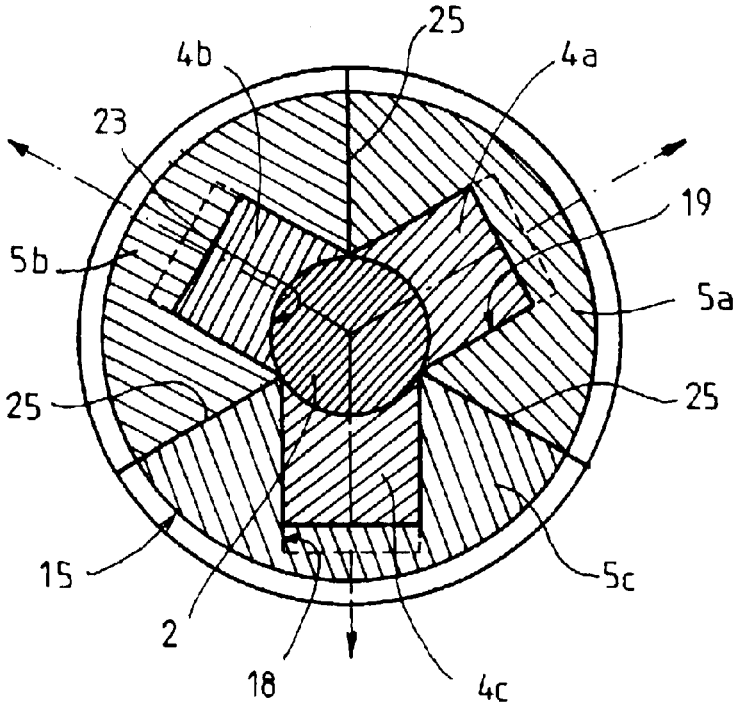
Figure 6:
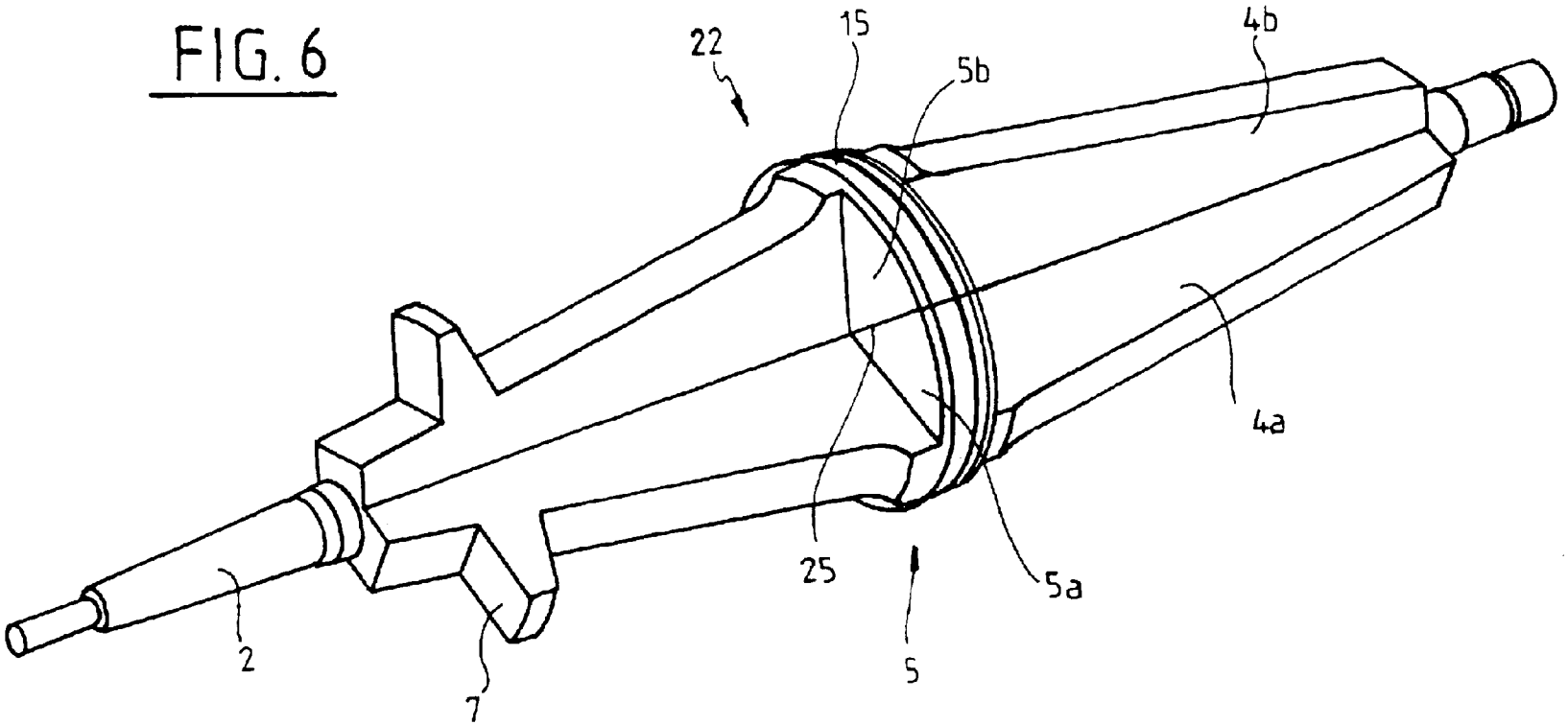
Figure 7:
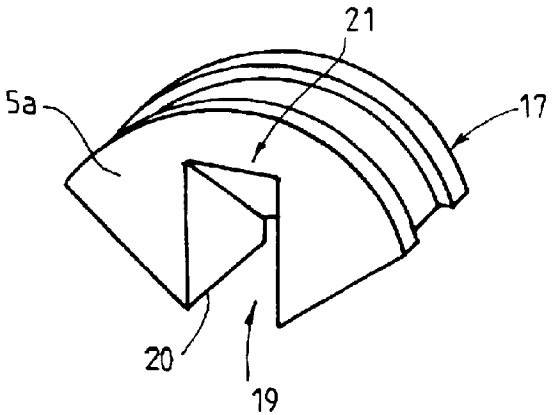
Figure 8:
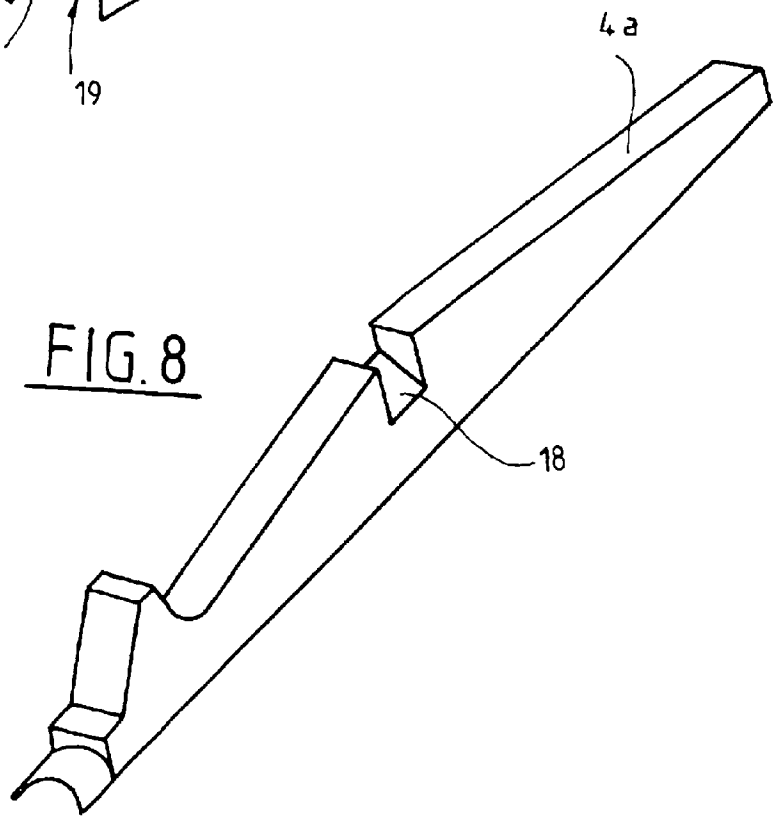

Other characteristics, particulars and advantages of the invention will become apparent from the following description given by way of illustration and in reference to the appended drawings, in which:

FIG. 1 shows a simplified side view of a piece of ammunition equipped with the sabot according to the invention, FIG. 2 shows an exploded view of the different elements constituting this sabot before assembly according to a first embodiment, FIG. 3 shows a first assembly phase of this sabot on a penetrator according to this first embodiment, FIG. 4 is a perspective view of a sabot according to this first embodiment of the invention in place on a penetrator, FIG. 5 is a cross section of the ammunition incorporating this first embodiment of the sabot, the section being made at the thrust plate, FIG. 6 is a perspective view of a sabot according to a second embodiment of the invention in place on a penetrator, FIG. 7 shows a perspective view of a sabot sector according to this second embodiment, FIG. 8 shows a perspective view of a sabot bar according to this second embodiment, and FIG. 9 is a cross section of the ammunition incorporating this second embodiment of the sabot made at the thrust plate.

DETAILED DESCRIPTION OF PREFERRED EMBODIMENTS

FIG. 1 shows a fin-stabilized projectile 1 comprising a penetrator 2 in the form of an elongated bar ending in a fin tail piece 3. This penetrator 2 is made of a heavy material such as tungsten or uranium alloy. This penetrator is associated with a calibrated sabot 22.

According to the invention, the sabot 22 comprises three longitudinal bars 4*a*, 4*b* and 4*c* (here only two bars may be seen) of substantially regular thickness, and a thrust plate 5 that is calibrated and integral with the bars 4.

The thrust plate 5 is fitted with a sealing belt 6. Each bar 4 is completed at its front by a stud 7 to guide the penetrator 2 in the gun barrel (not shown). The link between sabot 22 and penetrator 2 is classically made by threading or grooves.

Unlike in previous embodiments, the bars do not occupy an angular sector of an axisymmetrical shape around the penetrator but have a prismatic shape whose thickness is advantageously similar to the external diameter of the penetrator 2.

A first embodiment of the sabot is shown in FIGS. 2 to 5.

FIG. 2 is an exploded view of the sabot alone constituted of several segments: three bars 4*a*, 4*b* and 4*c* on the one hand, and three sectors 5*a*, 5*b* and 5*c* that form the thrust plate.

Each bar is of regular thickness and incorporates a face 8 facing the penetrator that is shaped to match its external surface. This face 8 has indentations 23 spread over two areas separated by a recess 9. The indentations co-operate with the external profile of the penetrator allowing it to be driven. We see that the bar is of a height that increases from the ends substantially towards a median part. The recess 9 in the bar is made at the median part. The bar also has two radial slots 10 and 11 that reduce its thickness at the median part.

Each sector 5*a*, 5*b* and 5*c* incorporates a footplate 12 and a side wall 13. The footplate 12 is intended to be applied against the penetrator 2 and is fitted, as is face 8 of the bars 4, with grooves or indentations intended to cooperate with corresponding grooves in the penetrator. Two reinforcing parts 14 are positioned between the side wall 13 and the footplate 12. The calibrated edge of the side wall 13 is machined so as to delimit a groove 15 intended to receive the sealing belt (not shown in FIGS. 2 to 5). Sectors 5 that constitute the thrust plate may be made by molding using an aluminum alloy.

FIG. 3 shows a first assembly phase of the sabot according to this first embodiment of the invention (to keep the Figure clear, the penetrator is not shown). The three sectors 5*a*, 5*b* and 5*c* are firstly positioned together to constitute the thrust plate around the penetrator. The sectors touch by their footplates 12 but the side walls 13 of two adjoining sectors are spaced and thus delimit a gap 24 of a width corresponding to the median thickness of the bars 4.

A bar 4 is thereafter slipped between two sectors and its face 8 applied against the penetrator to obtain the assembly shown in FIG. 4. During this assembly operation, the recess 9 of each bar caps the footplates 12 of the two sectors delimiting the gap 24. The length of this recess will be substantially equal to the length of the corresponding footplate. The bottom of the recess 9 is applied against the footplates 12 of the sectors under consideration. Such an arrangement allows the thrust plate 5 is been held better at the joint faces 25 (separation faces between the different sectors 5, these can be seen in FIG. 5). Gas-tightness is thereby improved.

Slots 10 and 11 of each bar 4 receive the walls 13 of the two sectors of the thrust plate delimiting the gap 24.

Such an arrangement also improves gas-tightness.

Finally, the belt is placed in the groove 15 that is thus partly arranged in the sectors 5*a*, 5*b* and 5*c* and partly in the bars 4*a*, 4*b* and 4*c*.

FIG. 4 shows the projectile with the penetrator 2 fully integrated into the sabot 22. The sealing belt 6 has been positioned in its intended place on the periphery of the thrust plate 5.

FIG. 5 is a cross section of the projectile, said section made at the groove 15. In this Figure, we see that it is the thrust plate 5 via its sectors 5*a*–5*c* that presses on the penetrator 2 at the median part of the projectile. Bars 4*a*, 4*b*, 4*c* come to press on the footplates 12 of the different sectors 5*a*, 5*b*, 5*c* on the joint faces 25 between the sectors 5*a*–5*c* between the gaps 24.

In a known manner, the segments are also held in position by rings and sealing means have been placed between the different segments. Joints (for example, silicon) may be provided in slots 10 and 11 separating bar and sector and/or along joint faces 25 between sectors. In this configuration, the plate 5 presses against the penetrator 2 and each segment extends on either side pressing against this penetrator.

A sabot 4 has been described that has three bars and three thrust plate sectors. It is naturally possible for a sabot to be made constituted by a different number of bars and sectors, for example, four.

A second embodiment of the sabot is shown in FIGS. 6 to 9.

This differs from the previous embodiment in that the thrust plate 5 is constituted by three identical sectors 5*a*, 5*b* and 5*c* that are not in contact with the penetrator 2 but which each cap a bar, respectively 4*a*, 4*b* and 4*c*.

FIG. 7 shows a perspective view of a sector Sa of the thrust plate 5. This sector is intended to be positioned on the bar 4*a* shown in perspective in FIG. 8.

To this end, sector 5*a* has a radial notch 19 intended to be housed in a matching notch 18 carried by bar 4*a*. Notch 18 in the bar 4*a* is made substantially at its median part. The thickness of the different bars 4 is similar to the external diameter of the penetrator (not shown).

In this embodiment, the bars 4 have no longitudinal recess 9 at their surface adjoining the penetrator. Each bar 4 thus presses over its full length on the penetrator 2. It is thus bars 4*a*–4*c* that drive the penetrator upon firing.

The notch 19 made in the sector 5*a* is of a width such that it presses on the side walls of the bar 4*a*. Similarly, notch 18 is of a width such that sector 5*a* engages in it at its solid part 21. In this way, notch 18 constitutes a means to retain the thrust plate. The bar ensures the mechanical strength of the thrust plate against the pressure of the propellant gases as well as the transfer of the propellant stresses to the penetrator to drive it.

FIG. 9 is a cross section of the projectile made at the groove 15. In this Figure we see that it is the bars 4*a*, 4*b* and 4*c* that press against the penetrator 2 via their profiles 23 that will be provided with indentations or threading. Sectors 5*a*–5*c* of the thrust plate are in mutual contact at joint faces 25.

FIG. 6 shows the projectile with the penetrator 2 fully integrated into the sabot 22. The sealing belt 6 (not shown) is positioned in its groove on the periphery of the thrust plate 5.

The architecture of the sabot according to one or other of the embodiment of the invention works well with the manufacture of bars from thick sheets of composite material onto which the thrust plate made of an aluminum alloy is placed. This arrangement allows the orientation of the laminate fibers to be easily defined so that their mechanical properties are best used, that is to say great longitudinal rigidity and high tensile and compression strength, always in the direction of the fibers.

With a composite material, the gain in mass is of around 30% with respect to the mass of an aluminum sabot.

The sabot according to the invention may also be made with bars and a thrust plate made of aluminum with high mechanical properties. In this case, the gain in mass with respect to an axisymmetrical sabot is considerable and is of around 10 to 15%.

The manufacturing cost for the sabot is particularly reduced since half-products can be used in the form of plates to be cut up according to the required geometry since the sabot-penetrator interface is machined.

By way of a variant of the second embodiment, the bar and thrust plate sector associated with it may notably be made as a single part in aluminum. The sabot thus made will be identical in shape to that in FIG. 6.

Various modifications may be envisaged without departing from the scope of the invention. In the case of the second embodiment (FIG. 6) for example, the thrust plate may be placed between two consecutive bars instead of at a single bar. A different number of bars and sectors may also be envisaged. The bars and/or thrust plate may also be made of a material associating composite and metal, for example a composite/metal sandwich.

What is claimed is:

1. A sabot for fin-stabilized ammunition firing in a gun barrel, comprising:

calibrated segments assembled around a sub-calibrated penetrator in the form of an elongated bar ending in a fin tail piece;

at least three longitudinal bars of a substantially constant width;

each said bar having indentations co-operating with an external profile of said penetrator to allow said penetrator to be driven wherein said indentations are substantially continuous along the length of each bar; and a calibrated thrust plate integral with said bars.

2. A sabot according to claim 1, wherein said bars have a prismatic cross section.

3. A sabot according to claim 2, wherein said bars are of a thickness similar to the diameter of said penetrator.

4. A sabot according to claim 1, wherein each said bar carries a stud on its front part to provide guidance in said gun barrel.

5. A sabot according to claim 1, wherein said thrust plate has a sealing belt that also joins said bars to said penetrator.

6. A sabot according to claim 1, wherein said thrust plate is divided into at least three adjoining sectors, each said bar carrying one sector of said thrust plate.

7. A sabot according to claim 6, wherein each said sector incorporates a radial notch that caps a matching notch carried on said bar.

8. A sabot according to claim 6, wherein said bars and said sectors are made of the same material.

9. A sabot according to claim 8, wherein each said sector is made as a single part with one of said bars.

10. A sabot according to claim 1, wherein said thrust plate is divided into at least three adjoining sectors, each said sector incorporating a footplate applied to said penetrator and integral with a calibrated wall, said walls of two adjoining sectors delimiting a gap to receive said bar.

11. A sabot according to claim 10, wherein each said bar comprises a recess on its face applied to said penetrator that caps said footplates of two adjoining sectors.

12. A sabot according to claim 10, wherein each said bar incorporates two radial slots reducing its thickness at a median part, such said slots receiving said walls of two adjoining sectors of said thrust plate.

13. A sabot according to claim 6, wherein said bars are made of a composite material and said sectors are made of a metallic material.

14. A sabot according to claim 5, wherein said thrust plate is divided into at least three adjoining sectors, each said sector incorporating a footplate applied to said penetrator and integral with a calibrated wall, said walls of two adjoining sectors delimiting a gap to receive said bar.

15. A sabot according to claim 10, wherein said bars are made of a composite material and said sectors are made of a metallic material.

* * * * *